US006401291B1

(12) United States Patent
Lee

(10) Patent No.: US 6,401,291 B1
(45) Date of Patent: Jun. 11, 2002

(54) TOOTHBRUSH

(76) Inventor: Chung-Fu Lee, No. 57, Yung Kang Street, Tai Bing City, Taichung (TW)

( * ) Notice: Subject to any disclaimer, the term of this patent is extended or adjusted under 35 U.S.C. 154(b) by 8 days.

(21) Appl. No.: 09/659,088

(22) Filed: Sep. 11, 2000

(51) Int. Cl.[7] ..... A46B 9/04
(52) U.S. Cl. ..... 15/167.1; D4/104
(58) Field of Search ..... 15/167.1; D4/104, D4/110

(56) References Cited

U.S. PATENT DOCUMENTS

| | | | | |
|---|---|---|---|---|
| 1,326,638 | A | * | 12/1919 | Block |
| 2,051,687 | A | * | 8/1936 | Dressler |
| D265,527 | S | * | 7/1982 | Macaluso |
| 5,242,301 | A | * | 9/1993 | Hickey et al. |
| 5,315,730 | A | * | 5/1994 | Kim et al. |
| D428,260 | S | * | 7/2000 | Harada |

FOREIGN PATENT DOCUMENTS

| | | |
|---|---|---|
| TW | 384214 | 3/2000 |
| TW | 386798 | 4/2000 |
| TW | 388684 | 4/2000 |
| TW | 390704 | 5/2000 |

* cited by examiner

*Primary Examiner*—Terrence R. Till
(74) *Attorney, Agent, or Firm*—Rabin & Berdo, P.C.

(57) ABSTRACT

The structural design of a toothbrush according to this invention mainly improves the shortcomings of the conventional toothbrush having difficult access of the bristles to the interproximal areas and the areas of the tooth surface at opposite sides of a person's mouth and blind spots on cleansing certain difficult-to-reach areas. The bristle head and the handle of such toothbrush of the invention are one-piece; and such bristle head is implanted with bundles of bristles; wherein the bristle head is bent downward with an angle between 45 degrees to 90 degrees relative to the horizontal axis of the handle (that is of any angle within the range of 45 degrees to 90 degrees between the bundles of bristles of the bristle head and the axis of handle) allowing such toothbrush to extend into the areas of the tooth surface at opposite sides of the mouth or the interproximal areas for a more effective cleaning of the teeth, and it in turn reduces mouth disease and provides a good preventive measure for teeth hygiene, and definitely a professional health care toothbrush.

2 Claims, 4 Drawing Sheets

TOOTHBRUSH

BACKGROUND OF THE INVENTION

1. Field of the Invention

The present invention relates to a toothbrush, and more particularly to a toothbrush having its bristle head bent downward with an angle between 45 degrees to 90 degrees relative to the horizontal axis of the handle of the brush.

2. Description of the Prior Art

The conventional toothbrushes, such as the ones disclosed in the R.O.C. Patent Numbers 386798, 388684, 390704, and 384214, usually include a bristle head having a plurality of at bundles of bristles implanted into the handle of the toothbrush. The handle and bristle head form a linear or a slightly curved streamline model, and the bristle bundle can be designed as long and short, or in a wave form in order to provide the user a comfortable way for tooth brushing according to his/her habit. In general, as we all know, when we brush our teeth at the inner side of our upper and lower jaw (i.e. the back of our teeth), the contact area between the bristle of the bristle head and the teeth is getting smaller, and it takes more time for us to brush those areas. Since the design for the bristle head and the handle of the toothbrush is of the same axis, it is not easy to brush the inner side of the teeth at the upper and lower jaws. If we insist our teeth in a large area, we must open our mouth to an extent to accommodate the brushing movement. If we need to brush and clean our teeth or tooth slits, our hand that holds the handle has to move to such a position, and it requires strenuous effort. In addition, there is still a blind spot on the teeth for cleansing by the bristle head, such as the wisdom tooth located at the rear part of the mouth, and it is still very difficult to clean that area or may even leave the tartar over there, which will increase the possibility of getting cavities or having gum diseases.

SUMMARY OF INVENTION

The toothbrush according to this invention incorporates the structure of bending the bristle head downward to an angle of either 45 degrees or 90 degrees with respect to the horizontal axis of the handle near the side of the bristle head allowing such toothbrush to extend into the areas of the tooth surface at opposite sides of the mouth and the interproximal areas for a more effective cleaning of the teeth, and it in turn reduces mouth disease and provides a good preventive measure for teeth hygiene, and definitely a professional health care toothbrush.

OBJECTIVE OF THE INVENTION

Therefore, the primary objective of the invention is to efficiently clean the inner side of the teeth at the upper and lower jaws and the inner tooth slits by brushing, and intend to effectively enhance the function of cleaning the inner side of the teeth and the inner tooth slits by applying ergonomic movements in the operation of the toothbrush, further attains the tooth hygiene effect, and becomes a second professional toothbrush.

To make it easier for our examiner to understand the objective of the invention, its structure, innovative features, and its performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Please refer to FIGS. 1, 3, 4, and 5. A preferred embodiment of this invention incorporates the structure of bending the bristle head downward to an angle of 45 degrees along the horizontal central line of the handle 2 near the side of the bristle head 1.

Figure 1:
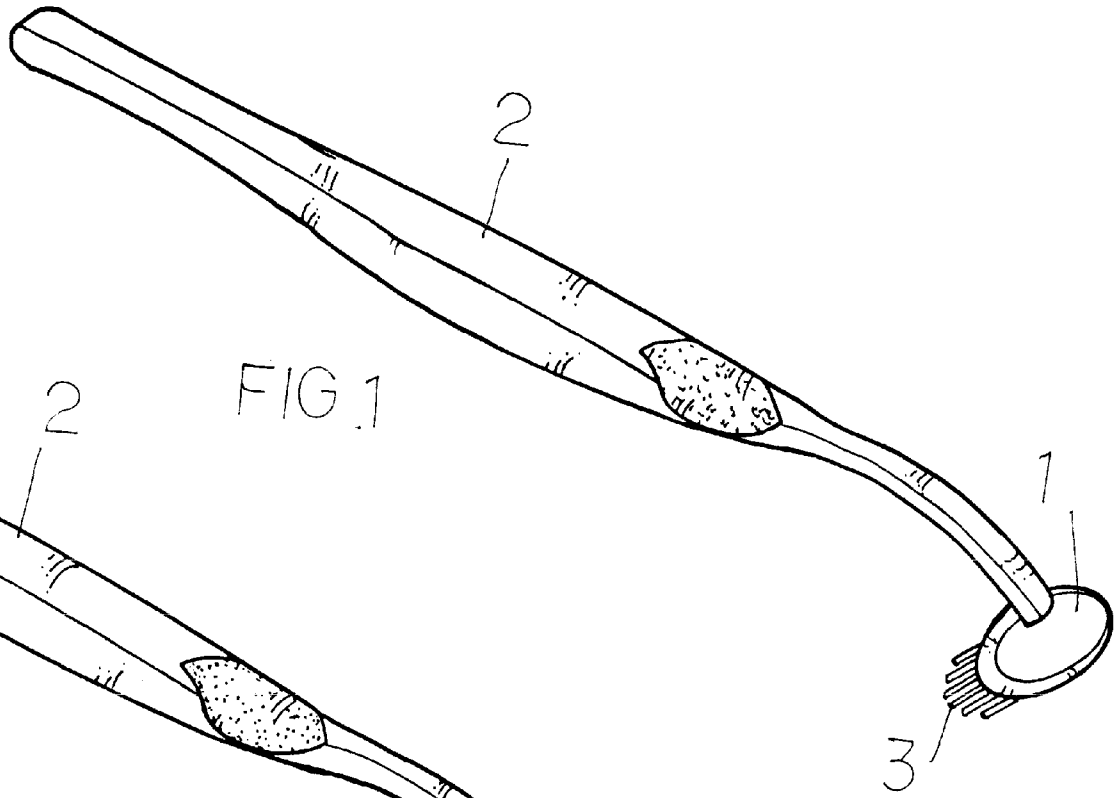
FIG. 1 shows the 3-dimensional diagram of a toothbrush having its bristle head bent 45 degrees downward according to the present invention.
Figure 2:
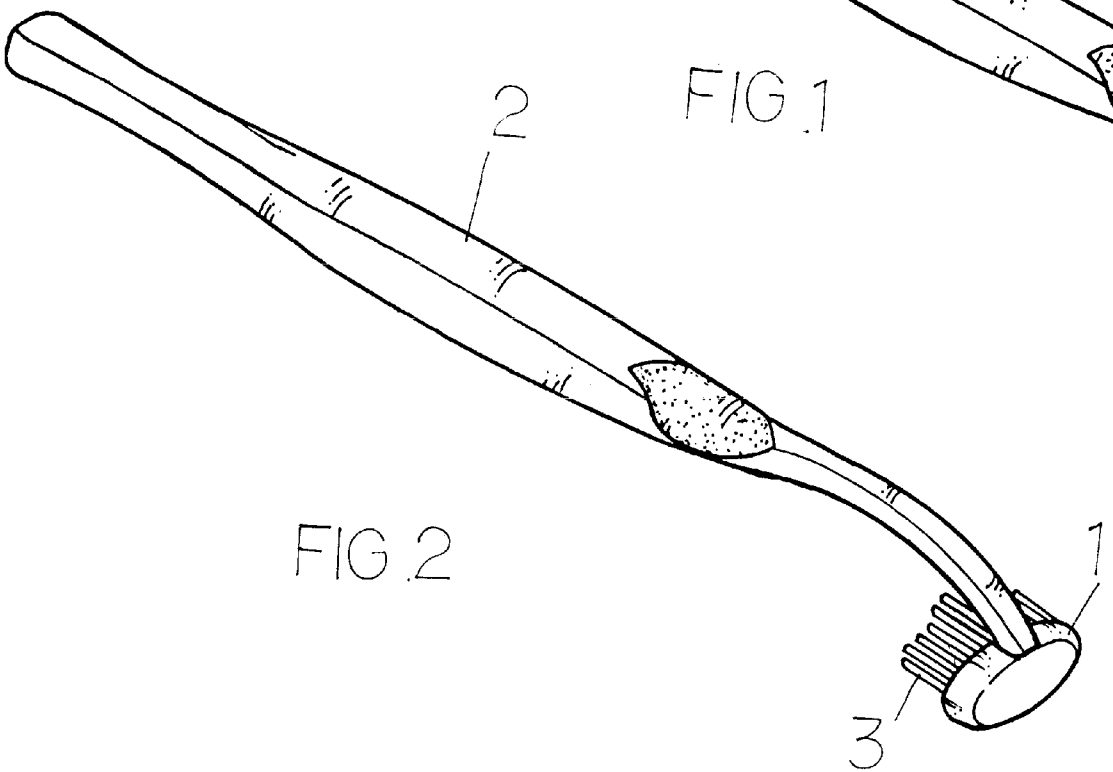
FIG. 2 shows the 3-dimensional diagram of a toothbrush having its bristle head bent 90 degrees downward according to the present invention.
Figure 5:
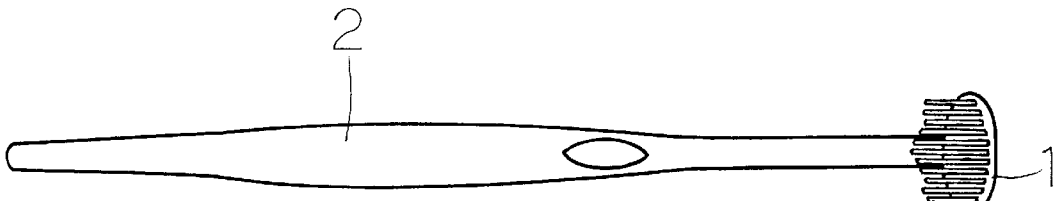
FIG. 5 shows the down-view diagram of a toothbrush hating its bristle head bent 45 degrees downward according to the present invention.
Figure 4:
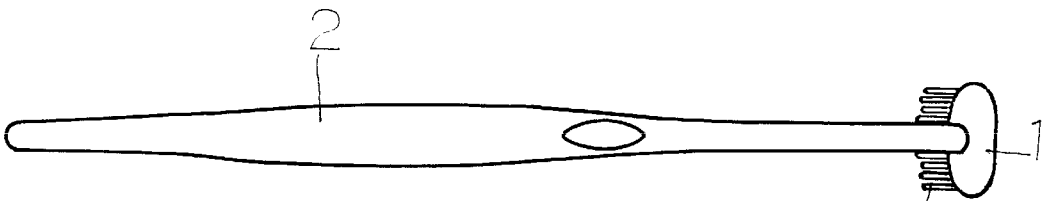
FIG. 4 shows the top-view diagram of a toothbrush having its bristle head bent 45 degrees downward according to the present invention.
Figure 3:
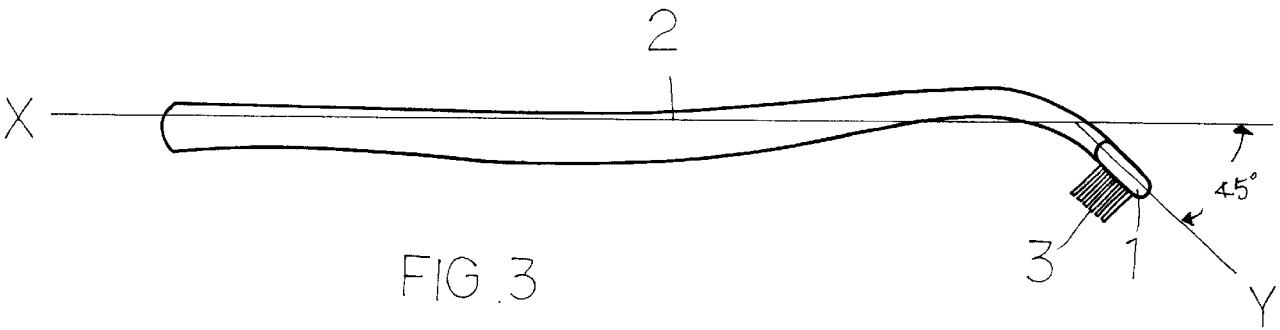
FIG. 3 shows the side-view diagram of a toothbrush having its bristle head bent 45 degrees downward according to the present invention.
Figure 8:
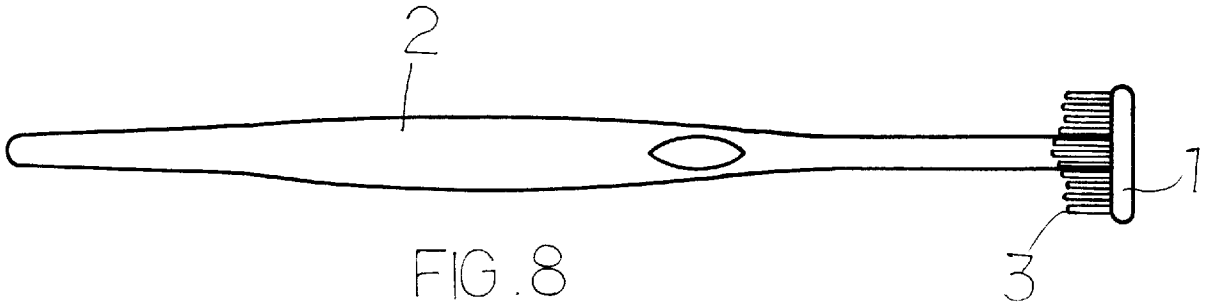
FIG. 8 shows the top-view diagram of a toothbrush having its bristle head bent 90 degrees downward according to the present invention.
Figure 7:
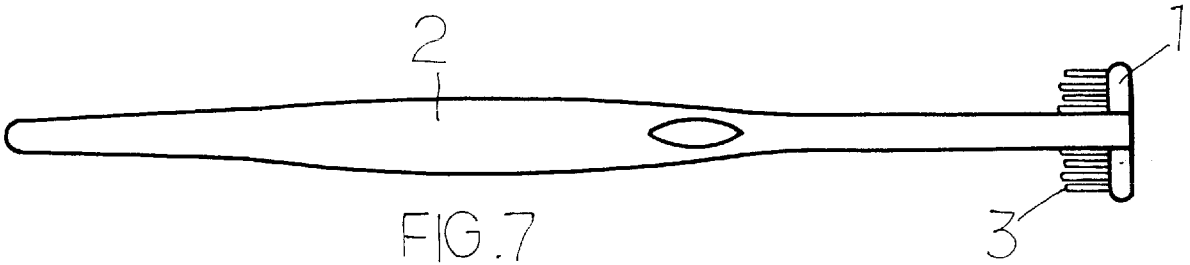
FIG. 7 shows the down-view diagram of a toothbrush having its bristle head bent 90 degrees downward according to the present invention.
Figure 6:
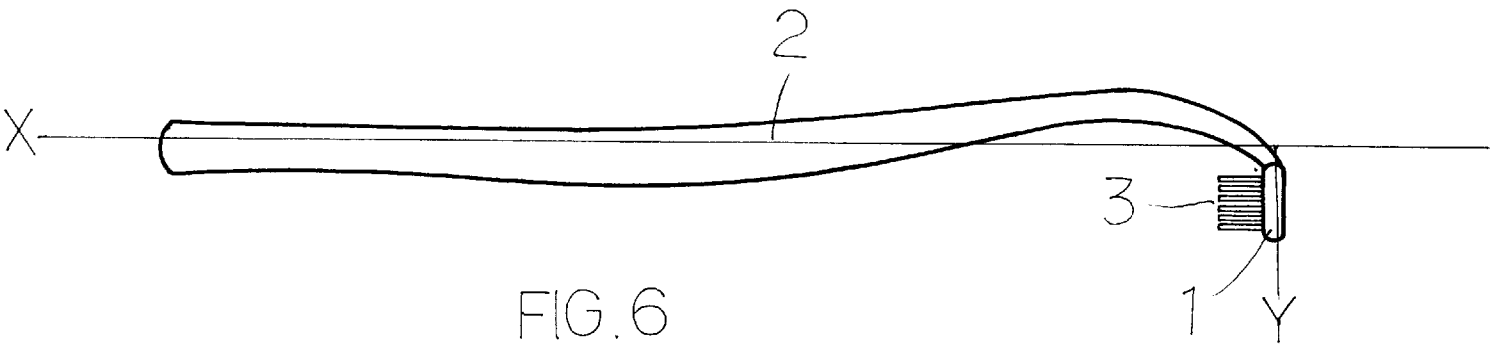
FIG. 6 shows the side-view diagram of a toothbrush having its bristle head bent 90 degrees downward according to the present invention.
Figure 9:
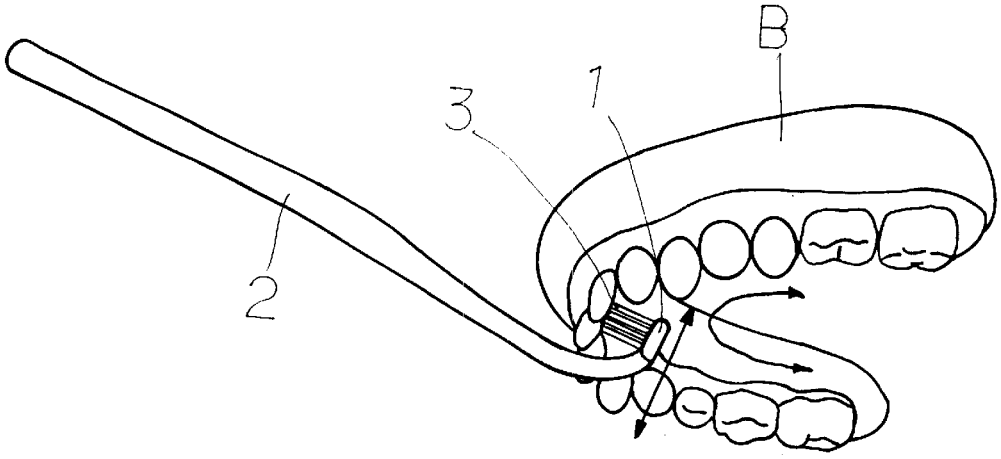
FIG. 9 is the three-dimensional diagram of the status of brushing the teeth at the upper jaw by the toothbrush according to the present invention.
Figure 10:
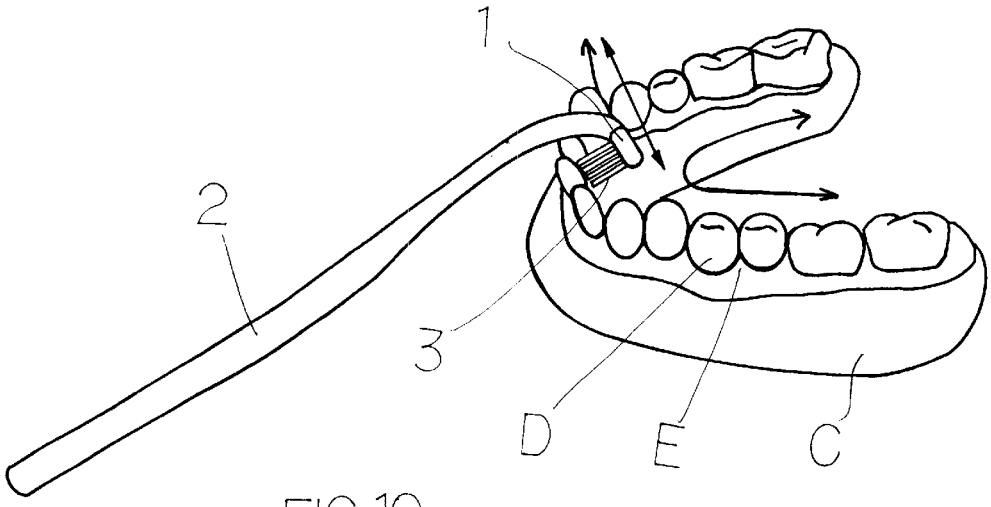
FIG. 10 is the three-dimensional diagram of the status of brushing the teeth at the lower jaw by the toothbrush according to the present invention.

Please further refer to FIGS. 2, 6, 7, and 8. Another preferred embodiment incorporates the structure of bending the bristle head downward to an angle of 90 degrees along the horizontal central line of the handle 2 near the side of the bristle head 1. Please refer to FIGS. 9 and 10 for the case when the toothbrush brushes the teeth B, C at the upper and lower jaws. When the toothbrush brushes the inner side of the teeth and the inner tooth slits, the bristles of the toothbrush will fully attach to the surface of the tooth, which allows the left, right, up, and down movement for the brushing on the inner side of the tooth surface for the tooth D at the upper jaw B and the lower jaw C. Therefore, the brushing can clean the tooth surface as well as the tooth slit E. It can take care of the blind spots or hard-to-reach areas, as the toothbrush extends into the inner side of the brushing tooth surface and tooth slit, and obtains a larger brushing area and removes the tartar and foreign substances more effectively. It further can prevent mouth diseases and has a good effect on tooth hygiene, and serves as a professional health care toothbrush.

The expected results are as follows:

(1) The toothbrush when used is ergonomic in its brushing movement, and can effectively enhance the cleansing of the inner side of the teeth and the tooth slits.

(2) It is easy to brush, and can extend to the inner side of the teeth and tooth slits for brushing and cleansing, and therefore effectively remove the tartar and foreign substances there.

(3) The bristle head increases the area being brushed, and favors the brushing, which will enhance efficiency as well as the brushing time.

(4) The inverted V design of the bristle bundles at the bristle head gives a better cleansing by having good contact with the tooth surface, and achieves a better brushing effect.

(5) The design of the bristle head having either 45 degrees or 90 degrees allows the cleansing at the back of the teeth. It eliminates the blind spots and the hard-to-reach areas.

In summation of the above description, the present invention improves the brushing of the teeth and tooth slits, and overcomes the shortcomings in the conventional toothbrushes, and further effectively enhances the tooth hygiene for our daily life.

As described above, the present invention is innovative and more advantageous than the conventional toothbrush having the foregoing advantages and complies with the patent application requirements. Hence the present invention is submitted to the Patent and Trademark Office for review and the granting of the commensurate patent. While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to enconmass all'such modifications and similar arrangements and procedures.

What is claimed is:

1. A toothbrush, comprising:

a handle; and a bristle head connected to said handle and having a flat base that is implanted with a plurality of bundles of bristles, said bundles of bristles implanted in a middle section of said flat base having a first length, and said bundles of bristles implanted on opposite sides of the middle section having a second length that is shorter than the first length, so that said plurality of bundles of bristles collectively define a V-shaped configuration, said bristle head being arranged at an angle between 45 degrees to 90 degrees relative to a central axis of said handle.

2. The toothbrush recited in claim 1, wherein said bristle head is arranged at a 90 degree angle relative to the central axis of said handle.

* * * * *